US006257146B1

(12) United States Patent
Stonebraker

(10) Patent No.: US 6,257,146 B1
(45) Date of Patent: Jul. 10, 2001

(54) NOISE MAKING PROJECTILE

(75) Inventor: Christopher P. Stonebraker, Trinidad, CO (US)

(73) Assignee: Stoneco, Inc., Trinidad, CO (US)

( * ) Notice: Subject to any disclaimer, the term of this patent is extended or adjusted under 35 U.S.C. 154(b) by 0 days.

(21) Appl. No.: 09/146,014

(22) Filed: Sep. 2, 1998

(51) Int. Cl.[7] ..... F42B 7/00

(52) U.S. Cl. ..... 102/346; 102/501; 102/513; 102/360; 102/502; 102/503

(58) Field of Search ..... 102/346, 360, 102/439, 447, 513, 438, 336, 357, 430, 502, 503, 501; 29/890.01

(56) References Cited

U.S. PATENT DOCUMENTS

| | | | | |
|---|---|---|---|---|
| 191,843 | | 6/1877 | Detwiller | 102/346 |
| 197,339 | | 11/1877 | Coston | 102/346 |
| 216,552 | | 6/1879 | Bogardus | 102/346 |
| 234,705 | | 8/1880 | Faure et al. | 122/168 |
| 621,553 | | 3/1899 | Behr | 102/346 |
| 3,062,144 | | 11/1962 | Hori et al. | 102/430 |
| 3,087,429 | * | 4/1963 | Nichols | 102/447 |
| 3,236,183 | * | 2/1966 | Littleford | 102/513 |
| 3,323,456 | | 6/1967 | Rothman | 102/346 |
| 3,349,707 | * | 10/1967 | Wortley, Jr. et al. | 102/346 |
| 3,505,924 | * | 4/1970 | Driscoll | 89/1.3 |
| 3,744,419 | * | 7/1973 | Hand | 102/360 |
| 3,793,955 | * | 2/1974 | Klecak | 102/335 |
| 4,457,233 | | 7/1984 | Hyde | 102/346 |
| 4,779,534 | * | 10/1988 | Wang | 102/334 |
| 5,235,915 | * | 8/1993 | Stevens | 102/439 |
| 5,394,635 | * | 3/1995 | Stuart | 42/70.11 |
| 5,652,407 | * | 7/1997 | Carbone | 102/438 |
| 6,092,467 | * | 7/2000 | Brice | 102/336 |

OTHER PUBLICATIONS

Bird Bomb Advertisement found in May 1, 1998, issue of "Gun List", p. 87.

* cited by examiner

*Primary Examiner*—Charles T. Jordan
*Assistant Examiner*—F. Chad Copier
(74) *Attorney, Agent, or Firm*—Ramon L. Pizarro; Edwin H. Crabtree

(57) ABSTRACT

A projectile for firing from an ammunition shell. The projectile includes an elongated hollow body of a resilient material, the hollow body further having a trailing end, a mid-portion, and a leading end, the leading end being closed and the trailing end having an aperture providing access to the interior surface. A propellant is included near the leading end of the hollow body and against the interior surface of the elongated hollow body, so that the interior surface of the hollow body between the trailing end of the hollow body and the mid-portion of the hollow body defines a hollow space. The projectile is adapted for placement within the ammunition shell to allow firing of the projectile from a shotgun or the like.

16 Claims, 3 Drawing Sheets

NOISE MAKING PROJECTILE

BACKGROUND OF THE INVENTION (a) Field of the Invention

This invention generally relates to a device for creating noise when fired from a gun. More particularly, but not by way of limitation, to a projectile which cooperates with a shell, the projectile being fired from a gun, preferably a shotgun, and including a whistling composition and may also include an exploding section.

(b) Discussion of Known Art

The need to scare away wildlife or deliver a signal charge to a desired distance has long been recognized. Unfortunately, however, known signaling devices of the type which create a loud noise in order to scare away wildlife suffer from limitations in safety, effectiveness and manufacturability. Similarly, devices which are use for signaling deliver pyrotechnic charges to a desired distance, within projectiles which are full of the pyrotechnic materials also suffer from limitations relating to stability, manufacturability, and effectiveness.

An example of an early device used for signaling by creating a bright explosion with a pyrotechnic projectile is taught in U.S. Pat. No. 191,843 to Detwiller. The Detwiller device is fired from a shotgun shell like housing, and includes a charge placed immediately over a primer, the charge being held against the primer by a wad. Attached to the wad is a cylinder of a highly combustible composition which is used as the charge. Attached to the cylinder is a fuse which delays the detonation of the cylinder, allowing the cylinder to reach the desired height or distance before exploding. A significant disadvantage of the Detwiller device is that due to the uniform configuration of the cylindrical projectile, the projectile may become unstable and thus tumble and self destruct before reaching its desired height or distance. Furthermore, it is known that it is desirable to include a loud whistling noise in combination with the explosive component in order to effectively frighten wildlife. Thus, the Detwiller device, while providing means for signaling, is limited in its ability to frighten and get rid of undesired wildlife without actually harming the animals.

Yet another early device which was used for signaling is taught in U.S. Pat. No. 197,339 to Coston. The Coston device is shot from a gun by means of powder ignited by a fulminate. The Coston signal cartridge includes a two stage fuse and rests immediately over the powder, so that upon ignition of the powder the fuse is also ignited. A limitation of the Coston device is that it requires the use of a fuse, which complicates the function and structure of the device. Additionally, the Coston device does not provide for whistling, reducing its effectiveness as a device for scaring away wildlife.

Another early device used for signaling by firing a pyrotechnic projectile is taught in U.S. Pat. No. 231,705 to Faure. The projectile of the Faure device includes a metal sleeve that holds a sound charge by means of a metal plug at one end of the sleeve and a cap at the other end of the sleeve. The metal plug includes a time fuse which permits the sound charge to detonate after the projectile has been launched. While the Faure device achieves its goals of providing a blast after launching, it is highly desirable to incorporate a whistle feature into such a projectile in order to frighten a wide variety of birds or animals. Still further, the Faure device is in essence a single solid projectile with its center of gravity somewhere near its geometric center. This kind of structure is vulnerable to tumbling. Tumbling can lead to self destruction of the device before detonation and, perhaps more importantly, to an unstable trajectory.

Another device which includes a projectile with structure that is similar to that of Faure is shown in U.S. Pat. No. 216,552 to Bogardus. The Bogardus device includes a fuse that connects a charge that is used for propelling the projectile; the explosive charge is held within the projectile. Additionally, the Bogardus device uses a wad between the projectile and the explosive charge to seal and isolate the projectile. Important limitations of the Bogardus device include the number of parts that are needed for fabrication, and the uniform filling of the body of the projectile with explosives, again presents the problems of tumbling. Moreover, the Bogardus device is not capable of whistling, which would enhance the effectiveness of the signaling ability of the projectile.

Yet another device for firing a signaling projectile is taught in U.S. Pat. No. 621,553 to Behr. The Behr device includes a projectile that mounts directly over a powder charge, which includes a section of granulated sulfur and a layer of magnesium. While the Behr device solves problems associated with providing a bright burning projectile, it does not address the importance of providing noise, as with a whistle. Additionally, the Behr device does not address the important functions of providing a projectile which can be fired to a known distance, and which will provide at least a whistling sound, and, if desired, a whistling sound that leads up to a loud blast or report to frighten away wildlife.

An examination of more recent signaling devices reveals a similar approach as was taken by the early devices. This includes U.S. Pat. No. 3,062,144 to Katsu Kenneth Hori et al., U.S. Pat. No. 3,323,456 to Rothman, and U.S. Pat. No. 4,457,233 to Hyde. These devices all include a primer, a charge immediately over, and in contact with, the primer, and a fuse which is ignited by the charge and which conducts the needed reaction to the different stages of the projectile. None of the above devices includes a whistle mechanism, and few address stability issues associated with the weight distribution of components of the projectile.

Thus it will be apparent from the above discussion that there remains a need for a simple projectile that is stable and which can be fired from a shotgun to carry a noise making component to a desired area or distance.

There remains a need for a simple signaling projectile that will not harm the barrel of the firing gun, and thus there remains a need for a projectile that provides the stability of known metal projectiles, but which is soft and stable enough to withstand the forces of the blast used to deliver the projectile from the gun.

There remains a need for a noise making projectile that serves for scaring away wildlife and the like by providing a loud whistling noise and which can be easily manufactured.

There remains a need for a simple noise making projectile which can be fired from a shotgun or the like and which can provide accurate, stable flight trajectory.

There remains a need for a projectile which uses few parts and which can be assembled consistently, without having to ensure that the pyrotechnic components are in contact with one another.

SUMMARY

It has been discovered that the problems left unanswered by known art can be solved by providing a projectile to be fired from a shotgun, the projectile includes:

a) an elongated hollow body of a resilient material, the elongated hollow body having an exterior surface, an interior surface, a trailing end and a leading end; and b) a propellant, the propellant being near the leading end and against the interior surface of the elongated hollow body, so that the interior surface of the hollow body next the trailing end of the hollow body is a hollow space.

It has been discovered that by providing a hollow body of a resilient material, such as an ABS polymer, and filling the leading end of the projectile body with a propellant, while leaving the trailing end unfilled, one achieves unexpected new and useful results. More specifically, it has been discovered that by filling the leading end of the projectile's body with a propellant, preferably as a solid or semi-solid unitary section, while leaving the trailing edge unfilled, one produces a highly stable projectile which cooperates with the barrel of the gun to advantageously harvest the gases used to propel the projectile from the gun and which maintains a stable trajectory once the projectile leaves the gun.

It has been discovered that the hollow trailing end of the disclosed invention can deflect or expand under the pressure of the propellant gases. This expansion of the trailing end provides a seal against the barrel of the gun, preventing or greatly reducing the occurrence of blow-by of the propellant gasses.

Furthermore, it has been discovered that by placing the desired pyrotechnic or propellant material at the leading end of the projectile, while leaving the trailing end hollow, results in a structure that exhibits highly stable flight trajectory and flight attitude, displaying little or no propensity to tumble.

In a preferred embodiment of the projectile, the leading end is also filled with a whistle composition in addition to a propellant composition. The propellant composition is placed closer to the trailing end than the whistle composition, facing an aperture in the trailing end of the projectile. The aperture in the trailing end is at a distance from the propellant composition.

In a highly preferred embodiment of the invention the projectile has been adapted for firing from a shotgun. In this embodiment, the projectile cooperates with a shell cartridge which includes means for accepting a primer and sidewalls which have been adapted for accepting most of the hollow body, allowing the leading end of hollow body to extend from the sidewalls of the cartridge. The aperture in the trailing end of the projectile has also been adapted for placement about the primer. This arrangement results in an assembly in which the propellant is at a distance from the means for accepting a primer and any primer that may be supported by the means for supporting a primer. It will be understood that this arrangement allows the primer to deliver a spark that travels through the hollow area of the first end of the invention before encountering and igniting the propellant.

In addition to the above preferred embodiment, it is also contemplated that a cap for accepting another desired pyrotechnic material may also be attached to the leading end of the instant invention. In a highly preferred embodiment, this cap will include a pyrotechnic composition for providing a flash and bang or crack. A highly preferred embodiment of this composition includes a mixture of potassium perchlorate, aluminum and sulfur.

The cap holding the pyrotechnic material will preferably fit and attach over the leading end of the hollow body. With this embodiment, the leading end of the hollow body will include an aperture through the leading end. The aperture will provide communication between the interior of the leading end of the hollow body and the interior of the cap.

It has been discovered that by placing a layer of propellant, followed by a layer of whistling composition at the leading end of the hollow body, to take advantage of the time required for combustion of the whistling composition to delay the detonation of the pyrotechnic composition. It has been discovered that the aperture at the leading end of the hollow body provides sufficient communication between the interior of the hollow body and the interior of the cap so as to cause detonation of the pyrotechnic material once the whistling composition has been consumed, and thus obviating the need to provide a fuse.

Thus, it will be appreciated that the disclosed projectile structure provides important new and useful results in ease of assembly.

Importantly, it will be appreciated that the disclosed structure obviates the need to incorporate fuses into the structure of the projectile, while preserving the staged reaction of the different pyrotechnic components of the invention.

Still further, it will be appreciated that the disclosed invention cooperates with the barrel of the gun producing new and unexpected results in the reduction of by-pass losses.

Furthermore, it will be appreciated that the disclosed invention provides for detonation of the propellant, placing the propellant at a distance away from the cartridge's primer.

It should also be understood that while the above and other advantages and results of the present invention will become apparent to those skilled in the art from the following detailed description and accompanying drawings, showing the contemplated novel construction, combinations and elements as herein described, and more particularly defined by the appended claims. It should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENT

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
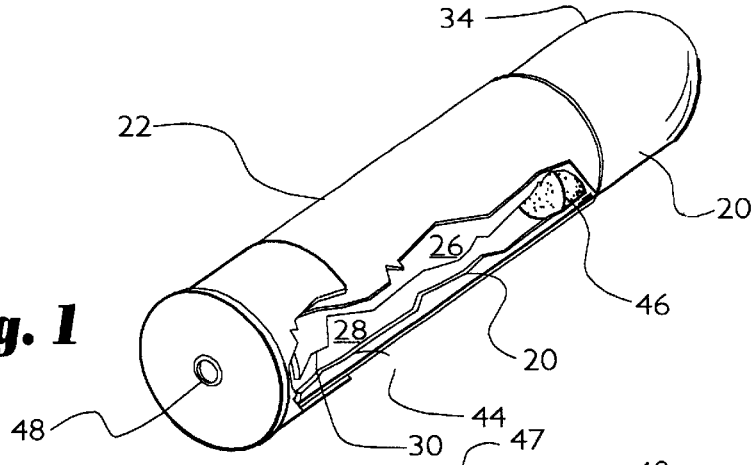
FIG. 1 is a perspective view of a highly preferred embodiment of the invention, the view including break-away sections illustrating the assembly of the projectile within a cartridge.
Figure 2:
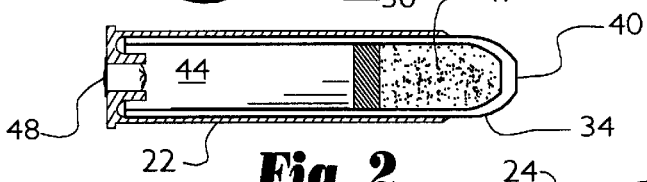
FIG. 2 is a side sectional view of the assembly shown on FIG. 1.

Turning now to FIGS. 1 and 2, where a highly preferred embodiment of the invention has been shown. FIGS. 1 and 2 illustrate that the invention includes a projectile 20 which may be fired from within a cartridge 22. It is important to note that the term cartridge should be interpreted to include shells or other artifacts used to hold a projectile and a firing primer for firing the projectile from a gun.

Figure 3:
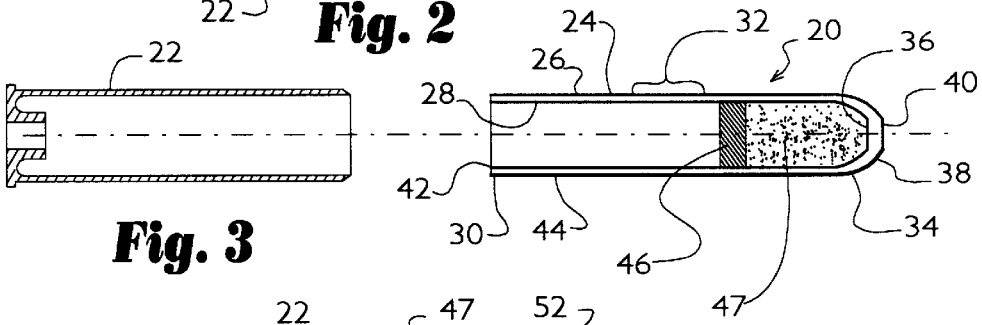
FIG. 3 is a side sectional view of the components shown assembled in FIG. 2.

Referring to FIGS. 1, 2 and 3 it will be understood that the projectile 20 includes an elongated hollow body 24 which will preferably be made from a resilient material, and most preferably of unitary, one piece, construction from a polymer having the resiliency and other properties similar to or better than those of an ABS polymer. The elongated hollow body has an exterior surface 26 and an interior surface 28, as well as a trailing end 30, a mid-portion 32, and a leading end 34. The leading end 34 of the embodiment is completely closed off by an endwall 36. In the embodiment shown on FIGS. 1–3 the endwall 36 incorporates an aerodynamic nose portion 38 which terminates in a generally flat area 40. The generally flat area 40 allows the user to load several cartridges 22 into the magazine of a shotgun, for example, and minimizes the chance of having the tip of the nose portion 38 of one projectile 20 to press against the primer of a cartridge ahead of the projectile, causing the cartridge to discharge.

Also illustrated in FIGS. 1–3 is that the trailing end 30 includes an aperture 42 which provides access to the interior surface 28 of the elongated hollow body 24. Thus, as illustrated, the aperture 42 at the trailing end 30 of the projectile 20 could be fairly described as a hollow skirt 44. The projectile 20 will also retain a chemical propellant 46, which is held within the hollow body 24. The propellant 46 will preferably be in cake or substantially solid form in order to cling onto the interior surface 28 of the projectile 20. Following the propellant 46 is a layer of a combustible whistle composition 47. The whistle composition 47 will preferably be made from a mixture of potassium perchlorate, sodium salicylate and red gum, and will generate a loud whistle noise as the products of combustion of the mixture escape the hollow body. The tone of the whistling sound will be controlled by the diameter of the projectile 20 and the length of the hollow skirt 44. Thus an examination of FIGS. 1–3 reveals that the hollow skirt 44 of the trailing end 30 will preferably terminate near the propellant 46, which will be near the leading end 34 and before the whistle composition 47.

Also shown on FIGS. 1–3 is that the elongated hollow body 24 will preferably be adapted for insertion and retention within the cartridge 22. The cartridge 22 of the preferred embodiment will be of a 12 gage shotgun caliber, and include a standard No. 209 shotgun shell primer 48. The aperture 42 at the trailing end 30 will preferably be adapted for fitting about the primer 48, so that the interior surface 28 of the hollow body between the trailing end 30 of the hollow body and the mid-portion 32 of the hollow body 24 can accept the discharge of the primer 48. Since the hollow skirt 44, or hollow area between the mid-portion 32 and the trailing end 30, of the projectile 20 provides access to the propellant 46, the placement of the hollow skirt 44 about the primer 48 allows the primer 48 to discharge towards and thus detonate the propellant 46.

Figure 4:
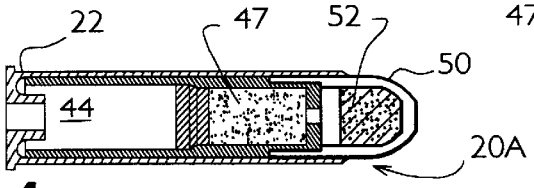
FIG. 4 is a side sectional view of the components of a highly preferred embodiment of the invention, the embodiment including a cap holding a pyrotechnic flash composition.
Figure 5:
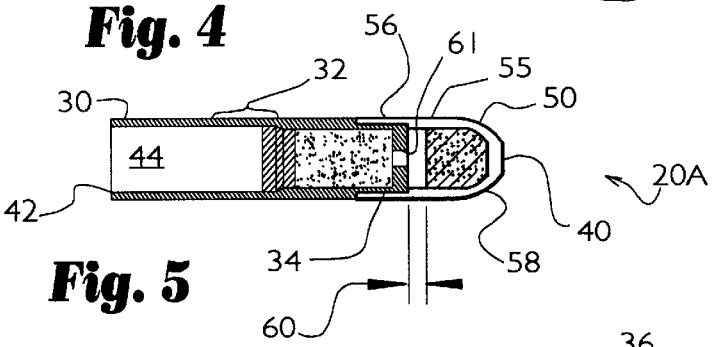
FIG. 5 is a side sectional view of the projectile components of the projectile shown assembled in FIG. 4.
Figure 6:
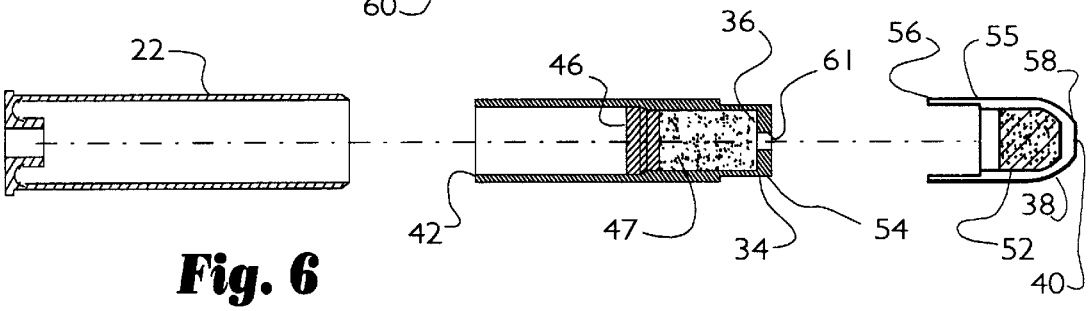
FIG. 6 is a side sectional view of the components shown assembled in FIG. 4.

Turning now to FIGS. 4–6 where a side sectional view of the components of a highly preferred embodiment of the invention have been shown, the embodiment including a cap 50 which carries a pyrotechnic flash composition 52, such as a mixture of potassium perchlorate, aluminum and sulphur, which will yield a loud report together with a bright flash. The cap 50 will preferably attach to the leading end 34 of the embodiment of the projectile 20A shown on FIGS. 4–6 by means 54 for attaching the cap 50 to the leading end 34 of the projectile 20A. These means 54 for attaching the cap 50 may include a recess that allows the assembly to maintain a smooth profile and an adhesive or a mechanical, welded or chemical joint.

As shown on FIG. 6 a preferred embodiment of the cap 50 includes a hollow body 55 with a trailing end 56 and a leading end 58. The trailing end 56 of the cap includes means for attaching the cap 50 to the leading end 34 of the elongated hollow body 24 of the projectile 20A or means for cooperating with the means 54 for attaching the cap 50 found on the projectile 20A.

Also shown on FIG. 6 is that in a preferred embodiment the pyrotechnic flash composition 52 is at a distance from the trailing end of the cap 50, so that when the cap 50 is attached to the leading end 34 of the hollow body 24 the pyrotechnic material is held at a distance 60 from the aperture 61 in the end-wall 36 of the hollow body 24. It is important to note that the detonation of the pyrotechnic flash composition 52 may be carried out without a fuse, but in a highly preferred embodiment of the invention a safety layer of 0.1 grams of black powder (not shown) is interposed between the whistling composition and the pyrotechnic flash composition 52 to prevent unwanted ignition of the flash composition.

Figure 7:
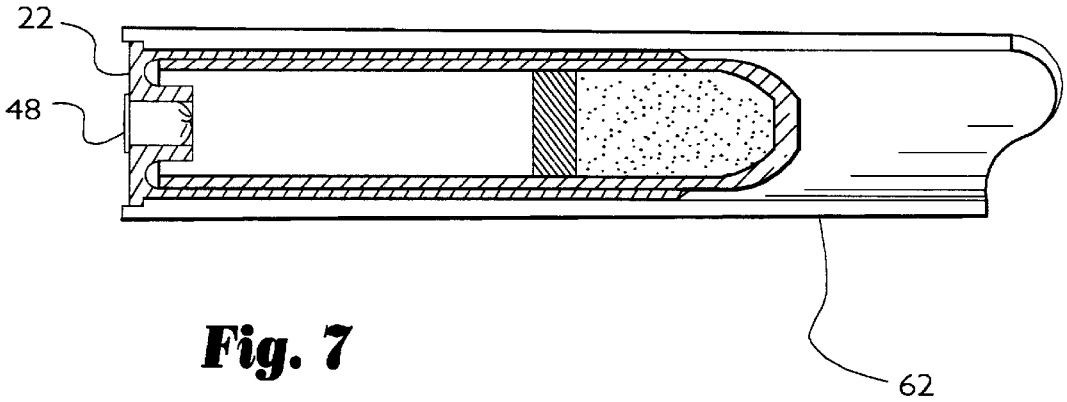
FIG. 7 is a side sectional view of the components shown assembled in FIG. 2 while in the firing chamber of a gun.
Figure 8:
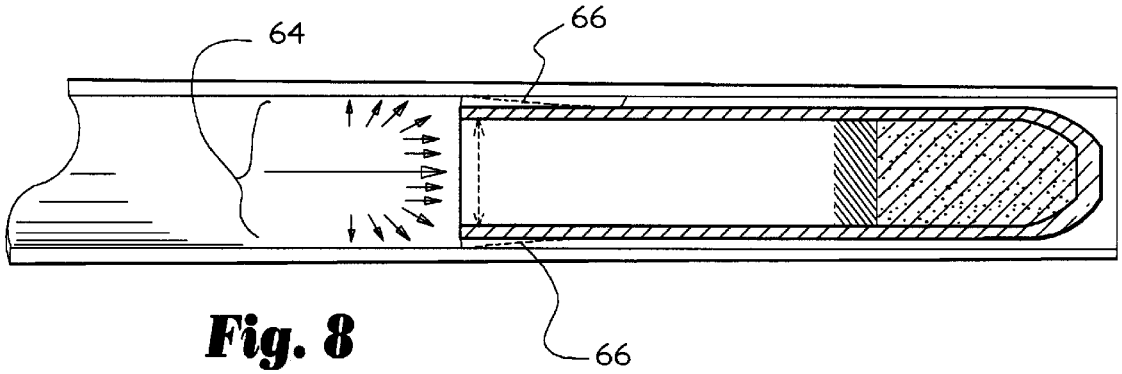
FIG. 8 is a side sectional view of the projectile shown assembled in FIG. 2 as the projectile travels through the barrel of the gun. The view also illustrating the reaction of the trailing end of the hollow body to the pressure created by combustion of the propellant.

The use of the instant invention will be understood with reference to FIG. 7, which is a side sectional view of the components shown assembled in FIG. 2 while in the firing chamber of a gun. The chamber is connected to the barrel 62 of the gun in a well known arrangement. Once the primer 64 is struck and the projectile 20 is fired from the cartridge 22, as the combustion of the propellant 46 will drive the projectile 20 through the barrel as shown in FIG. 8. Also illustrated in FIG. 8 are the pressure of the gasses, illustrated by arrows 64, produced by the combustion of the propellant 46. It is contemplated that these gases will fill the hollow skirt 44 and deflect the resilient walls of the hollow skirt 44 at the hollow trailing end 30 of the hollow body 24 in the direction arrows 65. The deflected skirt 44 has been shown in dashed lines indicated by the numeral 66. The radial deflection of the hollow skirt 44 will form a seal against the barrel 62 of the gun, minimizing the amount of blow-by losses while increasing the efficiency of the use of the products of combustion of the propellant 46 material.

Figure 9:
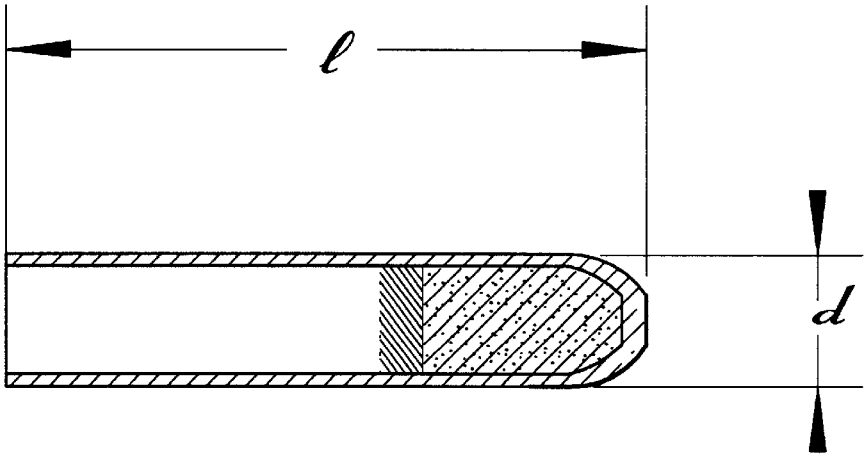
FIG. 9 is a side sectional view of the projectile components shown in FIG. 2, the view illustrating the relationship between the length to the diameter of the projectile.

Turning now to FIG. 9 where the relationship between the length, indicated by the letter "l" to the diameter of the projectile, indicated by the letter "d" has been illustrated. In a highly preferred embodiment of the invention the ratio of l divided by d will be about 3.7. While it is contemplated that a variety of other ratios may be used without departing from the spirit and scope of the invention taught herein, but it has been discovered that this ratio produces good results with regards to stability and aerodynamic drag.

Figure 10:
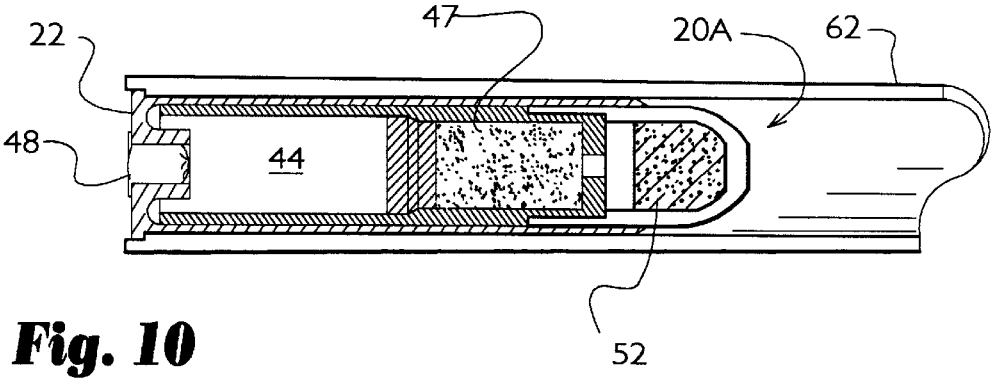
FIG. 10 is a side sectional view of the components shown assembled in FIG. 4 while in the firing chamber of a gun.
Figure 11:
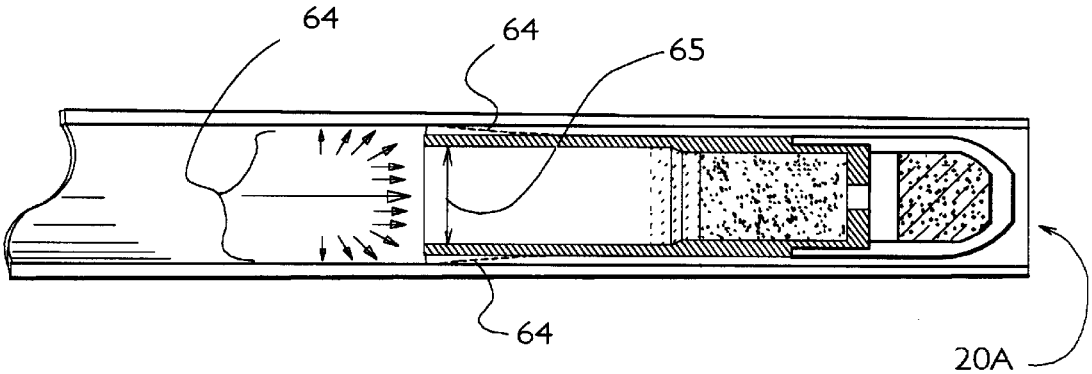
FIG. 11 is a side sectional view of the components shown assembled in FIG. 4 as the projectile travels through the barrel of the gun. The view also illustrating the reaction of the trailing end of the hollow body to the pressure created by combustion of the propellant.

Turning now to FIG. 10 it will be understood that the embodiment of the projectile 20A, shown on FIG. 4, will be used in same manner as the embodiment of the projectile 20. Similarly, as shown on FIG. 11 it is contemplated that the embodiment of the projectile 20A will also benefit from the deflection of the skirt 44 as the projectile 20A travels through the barrel 62 of the gun.

Figure 12:
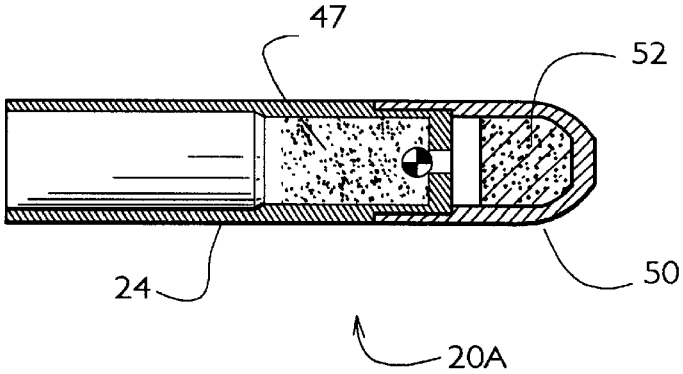
FIG. 12 is a side sectional view of the components shown assembled in FIG. 4 as the whistling compound is burned.
Figure 13:
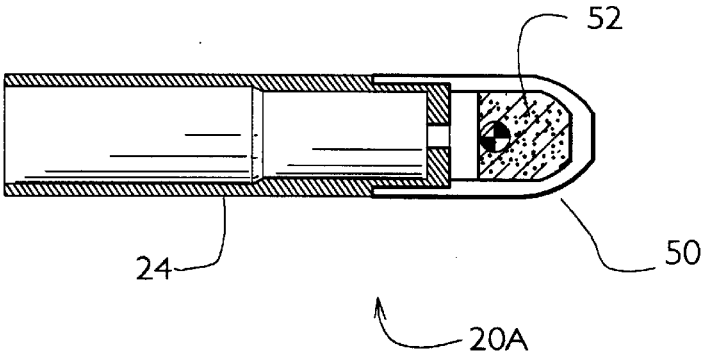
FIG. 13 is a side sectional view of the components shown assembled in FIG. 4 after the whistling compound has been burned and the pyrotechnic material in the cap is about to ignite.

Turning now to FIGS. 12 and 13 it will be understood that since the mass of the whistling compound is at or near the leading end 34 of the projectile 20 or 20A, most of the momentum or kinetic energy of the projectile will be near the leading end 34 of the projectile, while the trailing end 30 will carry far less kinetic energy due to the fact that the body of the projectile is hollow. With this arrangement any commencement of tumbling, by means of the leading end 34 decelerating faster than the trailing end 30, will be quickly extinguished due to the fact that commencement of tumbling will expose the trailing end 30 to aerodynamic drag as the trailing end 30 turns about the leading end 34. Since the trailing end 30 carries less kinetic energy than the leading end 34, aerodynamic drag will have a greater deceleration effect on the trailing end 30 than on the leading end 34, and thus quickly reduce the speed of the trailing end 30 so as to prevent the rotation of the trailing end 30 relative to the leading end 34.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A projectile for firing from an ammunition shell, the projectile comprising:

an elongated hollow body of a resilient material, the elongated hollow body having an exterior surface and an interior surface, the hollow body further having a trailing end, a mid-portion, and a leading end, the leading end having an endwall having at least one aperture and the trailing end having an aperture providing access to the interior surface;

a propellant, the propellant being near the leading end and against the interior surface of the elongated hollow body, so that the interior surface of the hollow body between the trailing end of the hollow body and the mid-portion of the hollow body defines a hollow space.

2. A projectile according to claim 1 and further comprising:

a cap comprising a hollow body having a trailing end and a leading end, the trailing end of said cap being adapted for attachment to said leading end of said elongated hollow body and further having a pyrotechnic material within said hollow body.

3. A projectile according to claim 2 wherein said pyrotechnic material is at a distance from the trailing end of said cap, so that when said cap is attached to the leading end of said hollow body the pyrotechnic material is held at a distance from said aperture in said end-wall.

4. A projectile according to claim 1 wherein said hollow body is unitary, one piece, construction.

5. A projectile according to claim 1 wherein said hollow body is of a polymer material having a resiliency similar to ABS plastic.

6. A projectile for firing from a shotgun ammunition shell, the projectile comprising:

an elongated hollow body of a resilient material, the elongated hollow body being adapted for insertion into the shotgun ammunition shell and having an exterior surface and an interior surface, the hollow body further having a trailing end, a mid-portion, and a second end, the leading end having an endwall having at least one aperture and the trailing end having an aperture leading to the interior surface;

a propellant, the propellant being near the leading end, at a distance from and opposite to said aperture in said endwall, and against the interior surface of the elongated hollow body, so that the interior surface of the hollow body between the trailing end of the hollow body and the mid-portion of the hollow body defines a hollow space.

7. A projectile according to claim 6 and further comprising:

a cap comprising a hollow body having a trailing end and a leading end, the trailing end of said cap having means for attaching said cap to said leading end of said elongated hollow body and further having a pyrotechnic material within said hollow body.

8. A projectile according to claim 7 wherein said pyrotechnic material is at a distance from the trailing end of said cap, so that when said cap is attached to the leading end of said hollow body the pyrotechnic material is held at a distance from said aperture in said end-wall.

9. A projectile according to claim 8 and further comprising a combustible whistle composition, the combustible whistle composition being within said elongated hollow body and between said propellant and said leading end of said elongated hollow body.

10. A projectile according to claim 6 and further comprising a combustible whistle composition, the combustible whistle composition being within said hollow body and between said propellant and said leading end of said hollow body.

11. An ammunition shell for a shotgun, the ammunition shell comprising:

a cartridge having means for accepting a primer; and a projectile comprising: an elongated hollow body of a resilient material, the elongated hollow body being adapted for insertion in said cartridge and having an exterior surface and an interior surface, the hollow body further having a trailing end, a mid-portion, and a leading end, the leading end having an endwall having at least one aperture and the trailing end having an aperture adapted for placement about the means for accepting a primer and for providing access to the interior surface;

a propellant, the propellant being near the leading end and against the interior surface of the elongated hollow body, the interior surface of the hollow body between the trailing end of the hollow body and the mid-portion of the hollow body defining a skirt section, the skirt section holds the propellant at a distance from the means for accepting a primer, so that the discharge of a primer will travel through the distance through the hollow body to the propellant.

12. A projectile according to claim 11 and further comprising:

a cap comprising a hollow body having a trailing end and a leading end, the trailing end of said cap having means for attaching said cap to said leading end of said elongated hollow body and further having a pyrotechnic material within said hollow body of the cap.

13. A projectile according to claim 12 wherein said pyrotechnic material is at a distance from the trailing end of said cap, so that when said cap is attached to the leading end of said hollow body the pyrotechnic material is held at a distance from said aperture in said end-wall.

14. A projectile according to claim 13 and further comprising a combustible whistle composition, the combustible whistle composition being within said hollow body of the cap and between said propellant and said leading end of said elongated hollow body.

15. A projectile according to claim 11 and further comprising a combustible whistle composition, the combustible whistle composition being within said hollow body and between said propellant and said leading end of said hollow body.

16. A projectile according to claim 11 wherein said hollow body is unitary, one piece, construction and of a polymer material having a resiliency similar to ABS plastic.

* * * * *